US007908975B2

(12) United States Patent
Forbes

(10) Patent No.: US 7,908,975 B2
(45) Date of Patent: Mar. 22, 2011

(54) HOLLOW RAILROAD CAR STRUCTURE

(75) Inventor: James W. Forbes, Campbellville (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 11/939,993

(22) Filed: Nov. 14, 2007

(65) Prior Publication Data

US 2009/0120323 A1 May 14, 2009

(51) Int. Cl.
*B61D 7/00* (2006.01)

(52) U.S. Cl. ..... 105/248; 105/247; 105/404; 298/24

(58) Field of Classification Search ..... 105/247–249, 105/396, 404; 298/8 H, 24
See application file for complete search history.

(56) References Cited

U.S. PATENT DOCUMENTS

| | | | | | |
|---|---|---|---|---|---|
| 4,361,096 | A * | 11/1982 | Funk | ..... | 105/248 |
| 4,484,528 | A * | 11/1984 | Anderson et al. | ..... | 105/248 |
| 4,898,101 | A * | 2/1990 | Harter | ..... | 105/247 |
| 6,098,744 | A * | 8/2000 | Kawamura | ..... | 181/198 |
| 6,237,505 | B1 * | 5/2001 | Sande et al. | ..... | 105/248 |

OTHER PUBLICATIONS

Series of photographs taken in 2005 of a rail road car manufactured by Trinity Industries, bearing the Umler car identification markings CEFX 96484.

* cited by examiner

*Primary Examiner* — S. Joseph Morano
*Assistant Examiner* — Zachary Kuhfuss
(74) *Attorney, Agent, or Firm* — Hahn Loeser & Parks LLP; Michael H. Minns

(57) ABSTRACT

An hollow railroad car may be a have a lading containment structure that is a pressure vessel. The car may be a covered hopper car having one or more hopper discharge sections. Each hopper discharge section may include a transition from a substantially rectangular upper inlet to a substantially circular outlet. The transition may include developed plate formed as partial conic sections fitted as valleys between respective pairs of fore-and-aft slope sheets and side slope sheets. The car may have substantially planar internal ring reinforcement assemblies that serve to form a jig and a welding surface for the fore-and-aft slope sheet, a self-jig for the skins of the side wall and roof sheets, and which define buckling nodes for longitudinal compression of the car. The rings form local T-sections in combination with the adjacent wall skins, and do not employ out-of-plane formed sections such as hat sections. The reinforcement may be fabricated from flat sheet or flat bar.

20 Claims, 8 Drawing Sheets

HOLLOW RAILROAD CAR STRUCTURE

FIELD OF THE INVENTION

This invention relates to the field of railroad freight cars, and, in particular to a structure for an hollow railroad car such as a covered hopper car.

BACKGROUND

There are many kinds of railroad cars for carrying particulate or granular material. These materials are not liquid, yet may in some ways tend to flow in a somewhat liquid-like manner. Many of those cars have an upper opening, or accessway of some kind, by which the particulate is loaded, and a lower opening, or accessway, or gate, by which the particulate material exits the car.

Consider, for example, a hopper car for transporting an almost powder-like material, such as flour or cement. Flour and cement tend to self-pack during motion of the car, such that the lading may not necessarily leave the car when a bottom gate is opened. One approach to the shipment and unloading of flour is to employ an air flow. Air is introduced at the gate to permeate the load, such that the load behaves like a fluidized bed, and hence is inclined to flow out the gate. Second, a jet of air is used to induce flow of the powder substance along an outflow conduit, much in the nature of an ejector pump. The powder leaving the gate is entrained in the airflow, and is carried to the desired destination. Railroad cars used for this purpose may have pressure vessel bodies. That is, the hatches seal, and, during unloading, the car may be modestly pressurized to perhaps 10 or 15 psi.

Although these cars are made of steel, the external shell may be thought of as a membrane. For example, the cars may have an overall width of 128 inches, and a wall skin thickness of roughly 3/16", giving an aspect ratio on the order of 700:1 The length of the car may vary depending on the density of the lading for which the car is built, but, typically may be of the order of 30-40 ft between truck centers, and perhaps 40 to 50 ft over the strikers.

SUMMARY OF THE INVENTION

In an aspect of the invention there is an internal reinforcement for a covered hopper car. It has a peripherally extending, substantially planar frame, the frame having a first portion and a second portion. The first portion of the frame defines a laterally extending member having a thickness, a depth, a first surface and a second surface. The depth is greater than the thickness, and may be at least 4 times the thickness. The first surface defines a planar land against which to mate an upper vertex of a first discharge slope sheet of the covered hopper car. The second surface defines a planar land against which to mate an upper vertex of a second discharge slope sheet of the covered hopper car. The second portion has first, second and third sectors, each sector having a thickness and a depth of section, The depth of section is greater than the thickness, and may be at least 4 times the thickness. The first sector has an external profile to which a first side sheet of the covered hopper car conforms. The second sector has an external profile to which a second side sheet of the covered hopper car conforms. The third sector has an external profile to which a roof sheet of the covered hopper car conforms. The frame has an internal opening formed therethrough, the internal opening having a periphery. The frame having an overall width. The internal opening periphery has an overall width. The overall width of the internal opening periphery is at last 80% of the overall width of the frame.

In another aspect of the invention there is a covered railroad hopper car. It has a lading containment shell carried on railroad car trucks. The lading containment shell has at least first and second hopper discharge sections, each having respective first and second slope sheets. The shell has an external skin. The shell has a shell periphery reinforcement located between the first and second hopper discharge sections. The shell periphery reinforcement being substantially planar. The shell periphery reinforcement has a first, cross-wise extending portion having first and second surfaces to which the first and second slope sheets mate. The shell periphery reinforcement has a second portion having sidewall and roof sheet profile defining portions. The shell has respective sidewall and roof sheets conforming to the profiles. The first and second portions of the shell periphery reinforcement combine to define a ring frame having an open interior portion.

In a different aspect of the invention, there is a covered railroad hopper car that has at least one hopper discharge outlet section having a generally four sided inlet, and a round outlet. There are a first and second side sill assemblies, each side sill assembly including a longitudinally extending channel section and a hopper discharge side sheet member, a portion of the hopper discharge side sheet portion mating with the longitudinally extending channel section to form a closed section beam. A pair of slope sheets extend cross-wise to the side sill assemblies, the pair of slope sheets being co-operably mounted relative to the side sheet members to form a four-sided pyramid opening.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
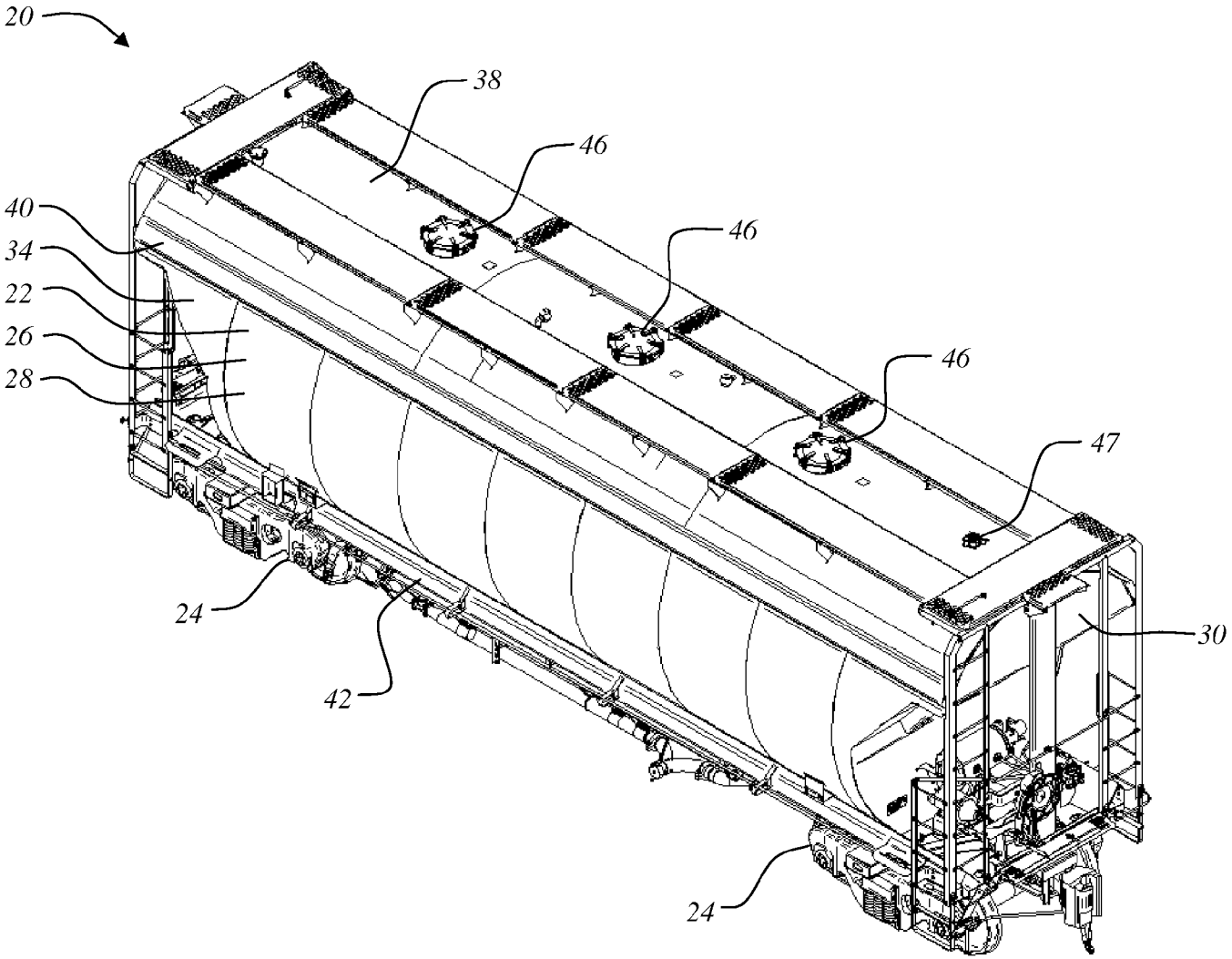
FIG. 1*a* is a general arrangement, isometric view of a railroad freight car such as may incorporate the various aspects of the present invention.
Figure 1B:
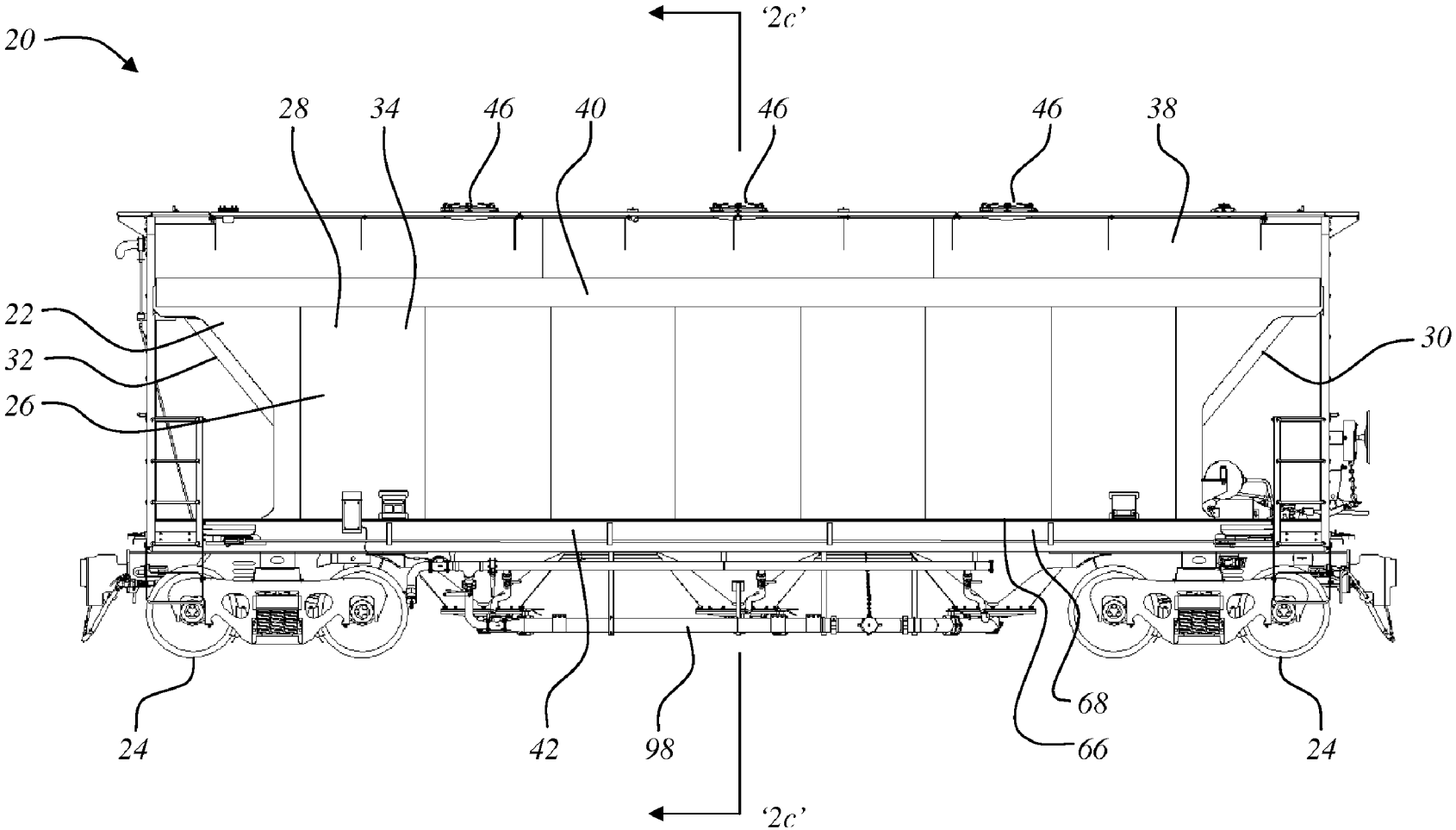
FIG. 1*b* is a side view of the railroad car of FIG. 1*a;*
Figure 1C:
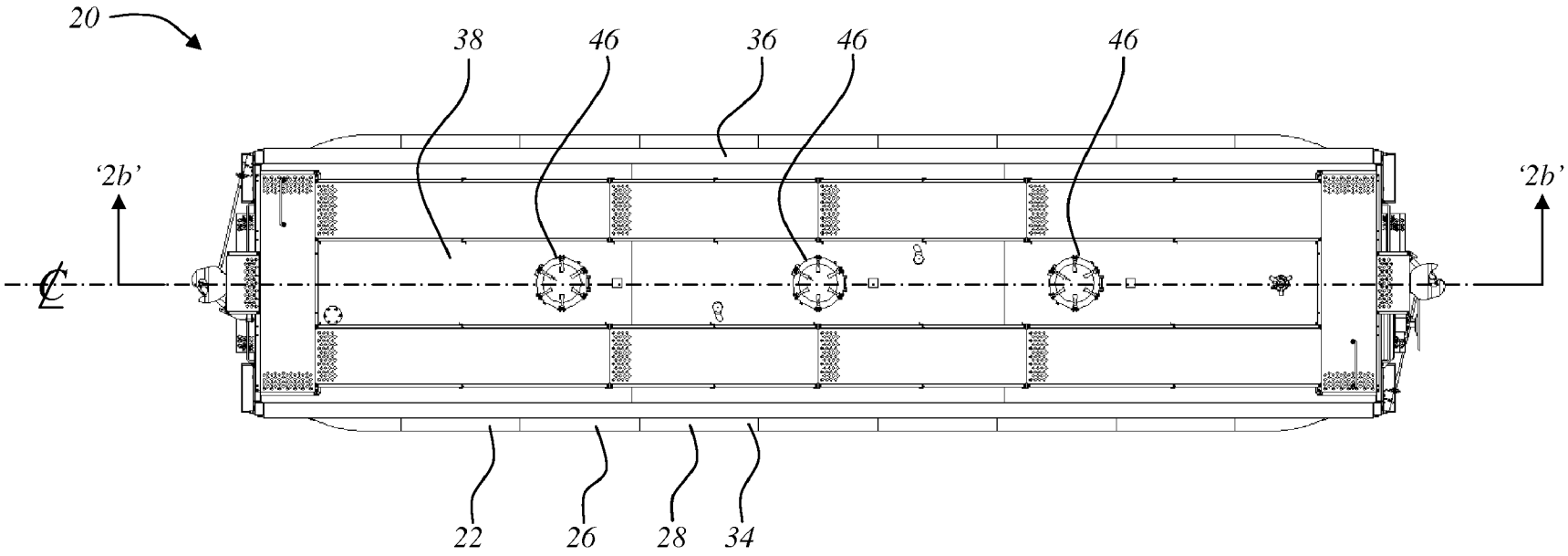
FIG. 1*c* is a top view of the railroad car of FIG. 1*a;*
Figure 1D:
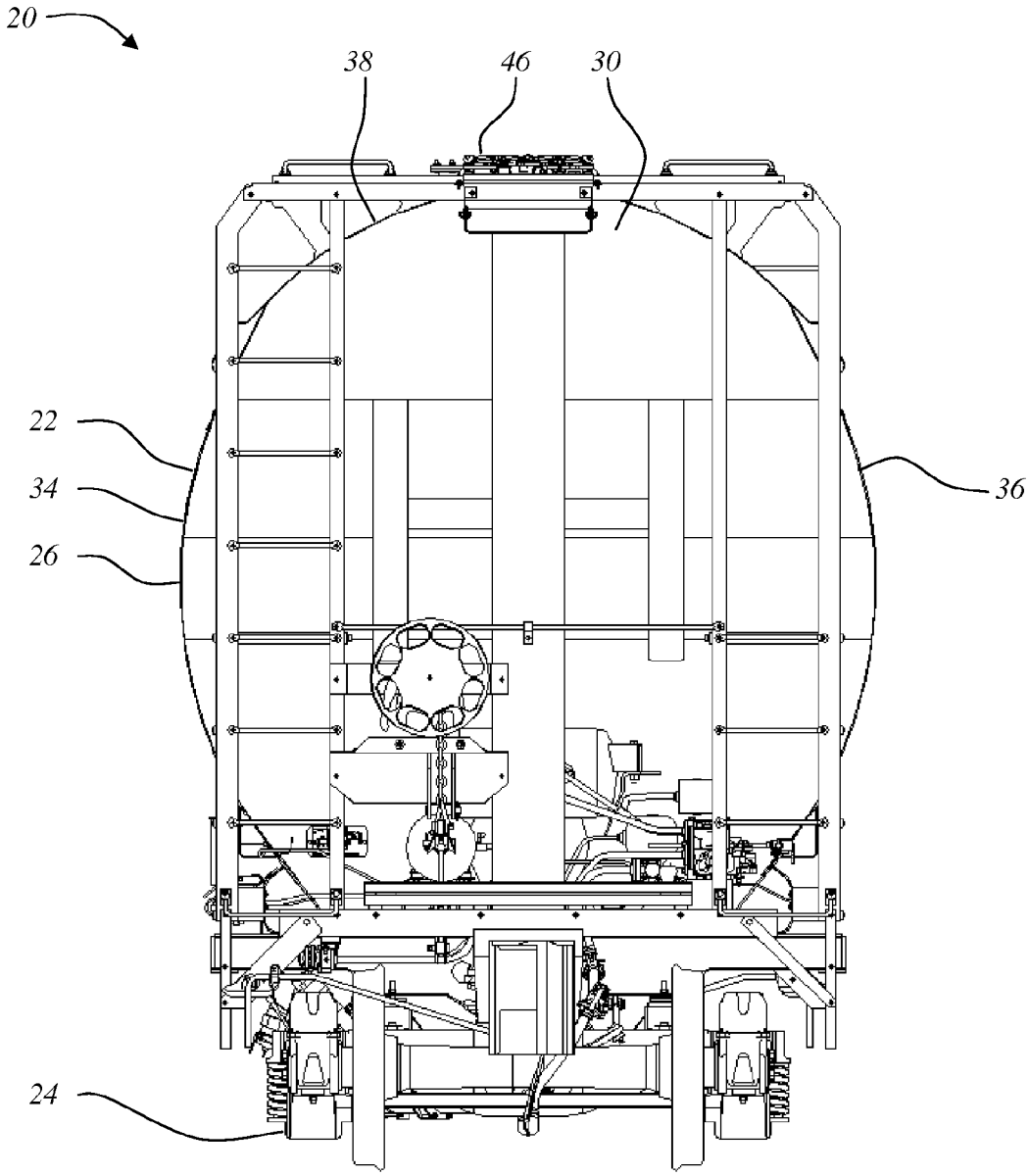
FIG. 1*d* is an end view of the railroad car of FIG. 1*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are generally to scale unless noted otherwise.

The terminology used in this specification is thought to be consistent with the customary and ordinary meanings of those terms as they would be understood by a person of ordinary skill in the railroad industry in North America. Following from decision of the CAFC in *Phillips* v. *AWH Corp.*, the Applicant expressly excludes all interpretations that are inconsistent with this specification, and, in particular, to confine the rule of broadest reasonable interpretation to interpretations that are consistent with actual usage in the railroad industry as understood by persons of ordinary skill in the art, or that are expressly supported by this specification, the inventor expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of at least 10 years experience in the railroad industry in North America or in other territories or former territories of the British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. In this description, the abbreviation kpsi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

FIG. 1*a* shows an isometric view of an example of a railroad freight car 20 that is intended to be representative of a wide range of railroad cars in which the present invention may be incorporated. While car 20 may be suitable for a variety of general purpose uses, it may be taken as being symbolic of, and in some ways a generic example of, a covered flow through car, in which lading is introduced by gravity flow from above, and removed by discharge through gated or valved outlets below. Covered flow through, or center flow cars may include open covered hopper cars, grain cars, plastic pellet cars, and so on. In one embodiment car 20 may be a pressurized discharge car for the carriage of bulk commodities in the form of a granular particulate such as cement or flour, and discharge may occur through a system of pipes. That discharge may be assisted by a fluid flow, such as an injected airflow. Other than ancillary fittings, the structure of car 20 may tend to be symmetrical about both its longitudinal and transverse, or lateral, centerline axes.

By way of a general overview, car 20 may have a car body 22 that is carried on trucks 24 for rolling operation along railroad tracks. Car body 22 may typically be of all welded steel construction, but this need not necessarily be so. For example, aluminum construction may also be considered. Car 20 may be a single unit car, or it may be a multi-unit car having two or more car body units, where the multiple car body units may be connected at an articulated connector, or by draw bars. Car body 22 may have a lading containment vessel, or structure, or shell 26. Shell 26 may include a generally upstanding wall structure 28 which may include a pair of opposed first and second end walls 30, 32, that extend cross-wise, and that may be, or may include, inclined end slope sheets 31, 33; a pair of first and second side wall assemblies, that may be identified as side walls 34, 36 that extend lengthwise; and a roof sheet or roof sheet assembly 38 that extends cross-wise between the upper portions of sidewalls 34, 36. The end walls 30, 32 and side walls 34, 36 co-operate to define a generally rectangular form of peripheral wall structure 28, when seen from above. Wall structure 28 may include top chords 40, 41 running along the top of sidewalls 34, 36, and side sills 42, 43 running fore-and-aft along lower portions of side walls 34, 36. In some instances car 20 may have stub center sills 44 at either end, in which case side walls 34, 36 may act as deep beams, and may carry vertical loads to main bolsters that extend laterally from the centerplates. Alternatively, or in addition to deep side beams, car 20 may include a straight-through center sill, running from one end of the car body to the other. In the case of a single, stand alone car unit, draft gear and releaseable couplers may be mounted at either end of the center sill. In a center flow, or flow through car, the upper portion of the car may typically include means by which to admit lading whether under a gravity drop or other system. For example, car 20 may include hatches 46 mounted in roof sheet assembly 38. Typically, hatches 46 may be mounted along the car centerline and may tend to be equal in number to the number of hopper discharge sections, although this need not necessarily be so. In the case where car 20 is a pressurized discharge car, hatches 46 may be sealed pressure hatches. A pressurizable car may also include pressure relief valves, as at 47 to prevent over pressurization.

Car body 22 includes intermediate slope sheets 51, 53 and internal reinforcement members of internal reinforcement assemblies that may extend between the sidewalls of the car, in a manner such as may tend to divide the internal space of car body 22 into two or more sub-compartments, sub-volumes or subspaces indicated generally as 50, 52 and 54 in this example, and which may be referred to as hoppers. Clearly, in some embodiments there may be one single hopper, in others two hoppers and in others three, four, or more hoppers. Each hopper has a discharge section or discharge assembly 60 that includes converging sloped members and an outflow. Each discharge section may tend to have the general shape and appearance of an upside-down pyramid. In the example of a pressurized discharge car that outflow may be substantially round at its outlet and may give onto outflow piping. That outflow piping may include air jets by which air may be introduced into the lading to cause the powdered lading to fluidize, and may include piping and air nozzles for entraining the outflow, and may include means by which to pressurize the car.

Each discharge section or assembly 60 may be bounded on the sides by side slope sheets 56, 57 that are downward and inward extensions of the skins of the sidewalls of the car; and on the ends by either (i) end slope sheets 31, 33 or (ii) internal slope sheets 51, 53. The lower portions of the side slope sheets may have a generally triangular shape when laid flat. Where there is a transition from a generally rectangular hopper to a round outlet there may be formed corner transition sheets or members 58 as well. Not atypically, each pair of fore-and aft opposed slope sheets, be they end sheets or internal slope sheets, may be inclined at equal and opposite angles, and the angles of those sheets may be selected to be somewhat steeper than the free slope angle, or natural angle of repose, of the lading for which the car is designed. Car body 22 may have relatively large end slope sheets which may tend to extend to a height relatively close to top chords 40, 41. That is, taking either the coupler centerline height or the center sill cover plate upper surface as a datum, slope sheets 31, 33 may terminate at a height that is at least half way to the top chord, and which may, in some embodiments, extend more than ⅔, ¾ or ⅘ of that distance, as may be.

Side slope sheet members 56, 57 may be steel plates, and may be positioned to co-operate with slope sheets 31, 33 to define a converging, or funnel-like passageway, or conduit, leading to an opening, indicated generally as 70, at which an exit, or port, or gate 62, however it may be termed, is defined. In the car shown, upper regions 64 of the sheets that form the side slope sheets of the hopper discharge also form one of the walls of the closed section of the side sill, and have an end extremity, or marginal edge 66, that extends somewhat beyond the juncture with U-pressing 68 which forms the other walls of the side sill. U-pressing 68 has an outer vertical leg, a substantially horizontal leg, a lower upwardly bent leg, and au upper inwardly bent leg. The slope sheet upper portion, or region, 64, runs across the ends of the inwardly and upwardly bent lower leg and the upwardly and inwardly bent upper leg, and, when welded thereto, a hollow pentagonal box section side sill is formed. Items 64 and 66 co-operate to form a single assembly on manufacture. The lower marginal edge 72 of the elliptic side sheet then overlaps, and mates with the upper region 64 of the side slope sheet in a lap joint, the lower edge of the upper sheet lying inboard of the upper edge of the lower sheet. The side sheets are then formed, or wrapped on the reinforcements 80, (discussed below) in a relatively simple assembly procedure. There is, in essence, slope continuity, or very close to slope continuity, at the lap joint at the side sill such that tensile forces induced in the side sheet under pressure (whether by the lading or otherwise) may tend to be passed into the slope sheet wall of the side sill without the generation of a significant bending moment at the welded joint. The side sheet may then be a continuous web, or skin, from the lap joint at the side sill to the junction at the top chord and roof sheet. The formation of the side sill and side slope sheet as a single assembly may tend also to avoid or reduce fit-up problems on assembly. That is, when seen in section, the sidewall is made up of only two sheets—namely the predominantly elliptic skin and the mating discharge section side slope sheet.

To the extent that the side slope sheets and end (or intermediate) slope sheets fit together and mate at their upper extremities (indicated generally at 74), the joining of the slope sheets and the rings to the side sill assemblies occurs before the installation of the side and roof sheets. The combined side sill assemblies and reinforcement ring assemblies (i.e., items 80) then form, in effect, a large self-jig on which the skins are mounted. The set of four transition members 58 are mounted along the corners of the converging sections of the longitudinal and side slope sheets. These transition members are, in effect tapered conic sections that provide the transition from the generally square or rectangular upper inlet region of the hopper discharge to the round outlet at pressure hatch 76 to which outlet ducting or piping 98 is connected. The tip or point of transition member 58 is located in, and forms, the valley between the respective pair of end and side sheets pointing upwardly. Transition members 58 are welded along one edge to the side slope sheets, along the other edge to the longitudinal slope sheet (be it an internal slope sheet or an end slope sheet), and, along the base of section, form a quarter of a circle on assembly, such that the four members form a circle to which the circular hatch assembly of pressure hatch 76 can mount.

Car 20 may include a fitting or fitting assembly, or reinforcement 80 mounted midway between the centers of two adjacent hopper discharge section outlets. Reinforcement 80 may lie in a vertical plane bisecting the apex where the planes of two adjacent slope sheets (e.g., 51, 53) would otherwise meet at a line of intersection. That is, to the extent that car 20 has a longitudinal centerline, vertical planes may be constructed through the centerlines of the hopper discharges perpendicular to the longitudinal centerline. Reinforcement 80 may be a substantially planar reinforcement that lies in a vertical plane perpendicular to the longitudinal centerline of the car and between, and equidistant from the plane constructed through the centers of the adjacent discharge sections.

In the past, hoop stiffeners have been used in hopper cars. However, they have tended to include hat sections or other out-of-plane formed members whose juncture with the intersection apices of the fore-and-aft inclined slope sheets has been problematic in the view of the present inventor. Relatively complex fitting arrangements have been used to mate these various parts. It is the very complexity that is a disadvantage in the view of the present inventor. Their fabrication and installation tends to be fussy and expensive, and may in the end be poorly done notwithstanding. By contrast, the present inventor has employed reinforcement 80. Reinforcement 80 may tend to be free of out of plane bent sections. Reinforcement 80 has a first portion 82 that runs cross-wise between the side sheets at a level at or near the height of the side sills. For the purposes of this description, if the side sills have an overall section depth (or height) h, "at or near" in the preceding sentence may be taken as meaning within twice h of the side sills. As such the first, or lateral base portion 82 of reinforcement 80 functions as a ridge plate having first and second surfaces against which the upper end vertices of the respective adjacent slope sheets 51, 53 mate at a clean, relatively easily made fillet weld. This may tend to avoid the fit-up problem associated with trying to weld the two vertices together. As may be noted, lateral base portion 82 extends a considerable distance above, and a clear distance below the ideal locus of intersection of the planes of the adjacent inclined slope sheets so that there is, in effect, a jig fitting or backing member that extends both above and below the joint, and that provides a surface to which a good, clean fillet weld can be made.

Figure 2A:
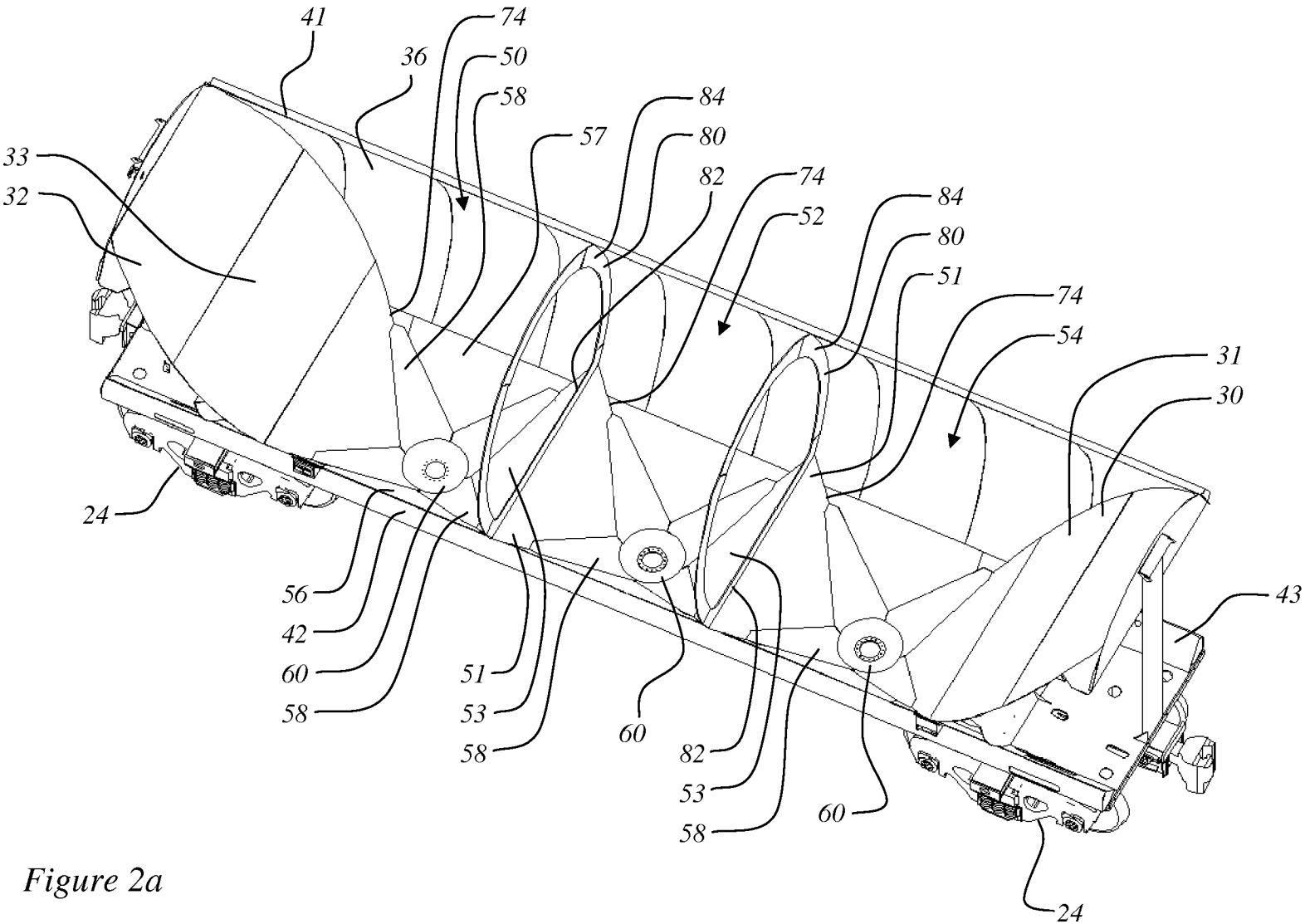
FIG. 2*a* is a sectioned perspective view of the railroad car of FIG. 1*a;*
Figure 2B:
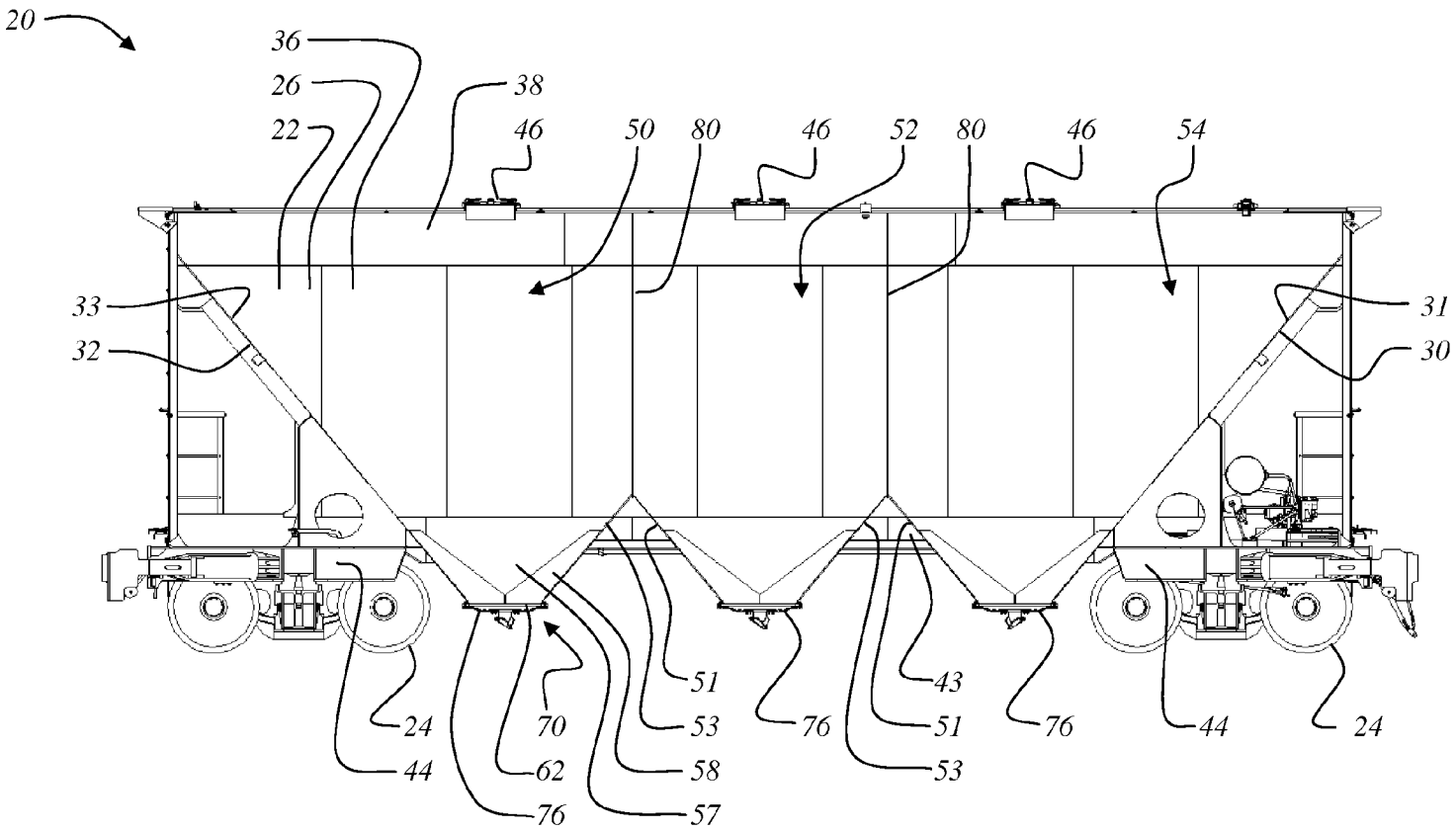
FIG. 2*b* shows a sectional view of the railroad freight car of FIG. 1*a* taken on section '2*b*-2*b*' of FIG. 1*d*, along the longitudinal centerline of the car.
Figure 2C:
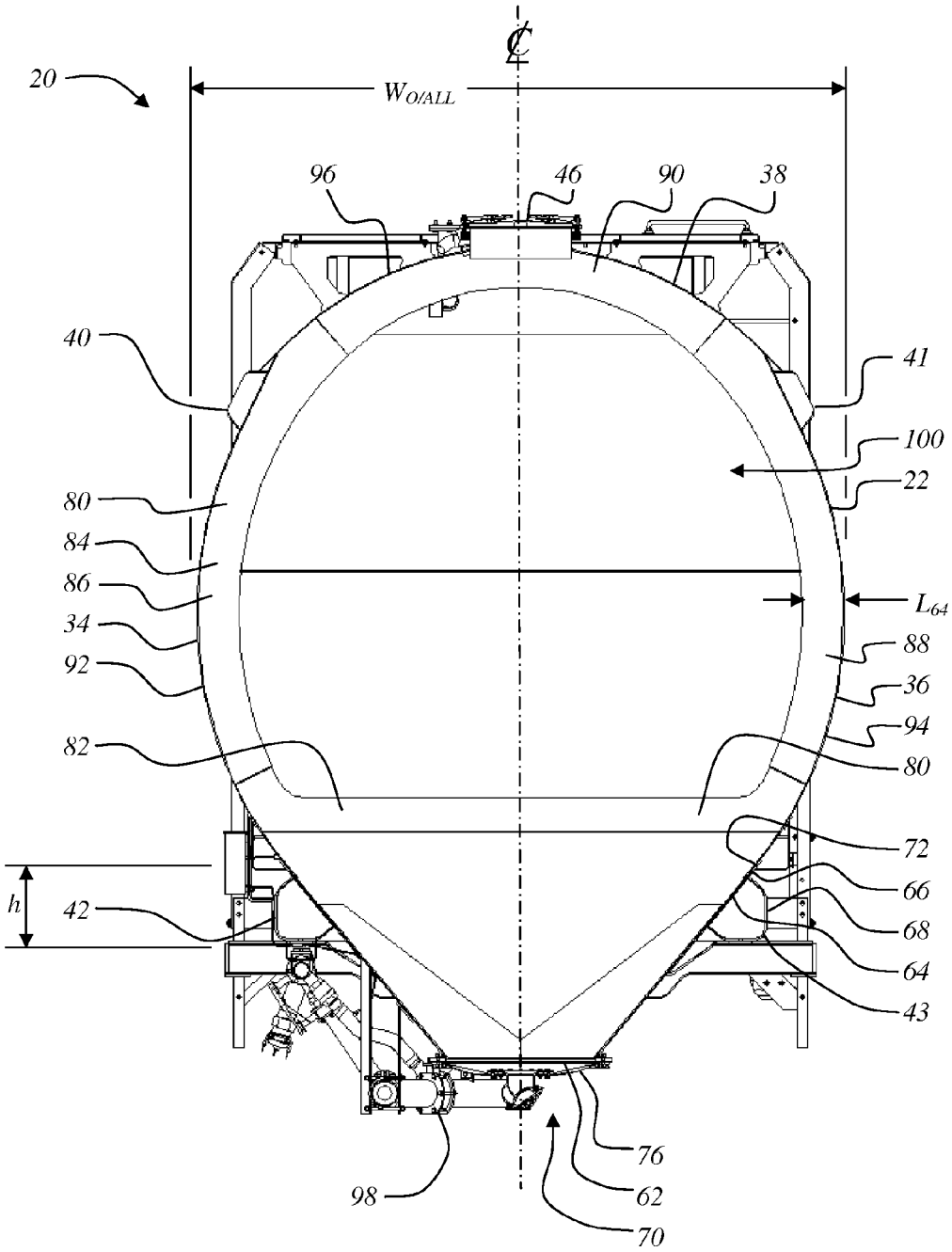
FIG. 2*c* shows a transverse sectional view of the railroad freight car of FIG. 1*a* taken on section '2*c*-2*c*' of FIG. 1*b*, through the central discharge section at mid-span.
Figure 2D:
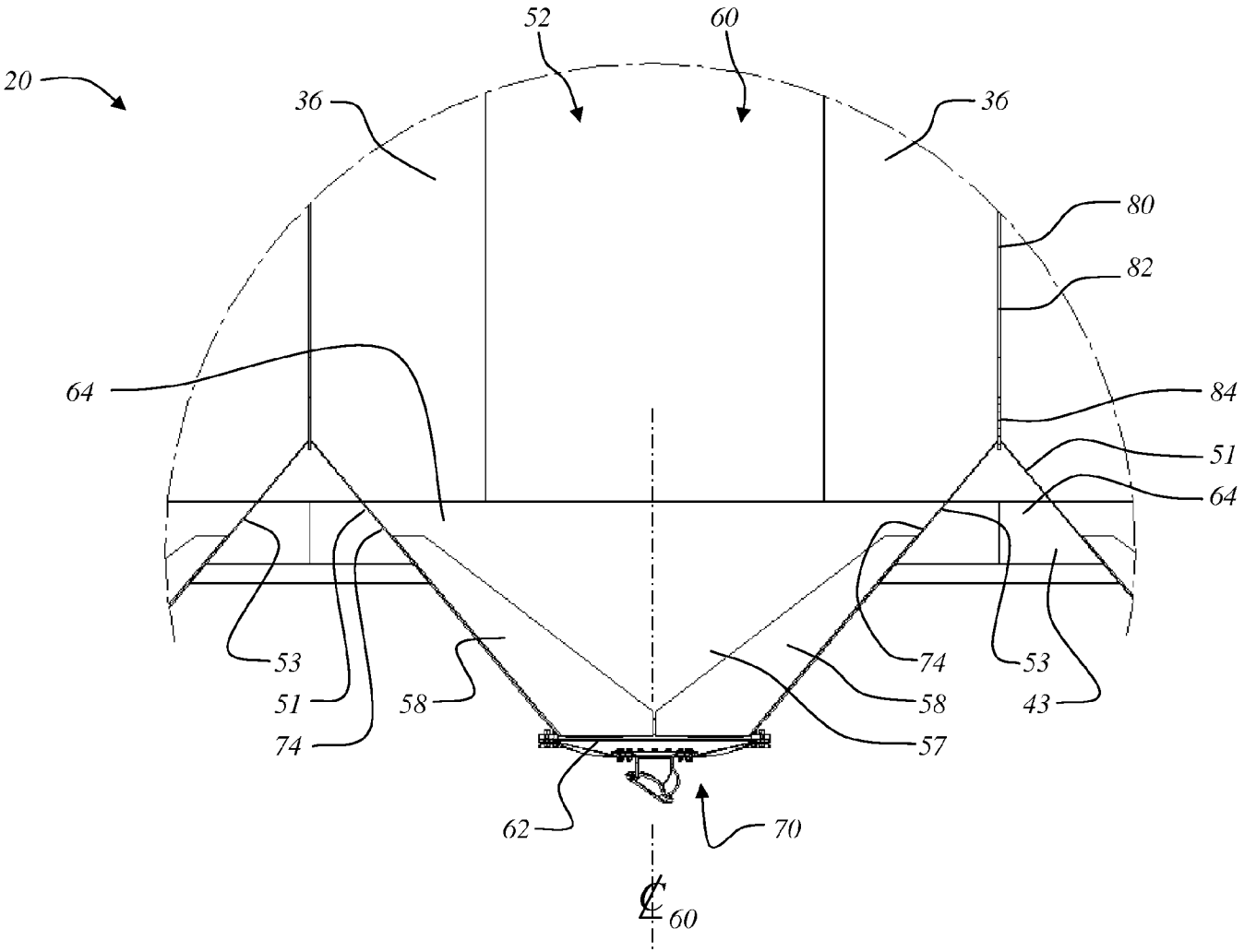
FIG. 2*d* shows an enlarged view of a detail of FIG. 2*b*.

Reinforcement 80 also includes a second portion 84, which has the general shape of an inverted horseshoe. This horseshoe, or bulging shape may be thought of as having three portions or sectors, those portions or sectors being a first sector 86, a second sector 88 and a third sector, 90. First sector 86 may be thought of as being associated with the first sidewall 34, and extending between the first side sill and the first top chord. Similarly, the second sector, 88 may be thought of as being associated with the second sidewall 36. The third sector 90 may be thought of as being associated with roof assembly 38. The outer edges of these respective sectors each have an external profile, and the skins of the structural shell, being identified as 92, 94 and 96 respectively, conform to the profiles of these sectors. The sectors also have an internal profile. It may be, as in the embodiment illustrated, that this internal profiled edge may generally follow the same shape as the outside edge, such that the leg length $L_{64}$ (i.e., the distance from the outside edge to the inside edge, taken perpendicular to the local tangent to the curve) is roughly constant, although this is not necessarily so. The inner profile edge may be a smooth curve without slope discontinuities, and may have corresponding circular and elliptic portions. The three sectors (and, indeed, reinforcement 80 in its entirety) may be fabricated by being cut as a monolith from a single piece of rolled sheet. However, in the embodiment illustrated these sectors are cut from sheet, and butt welded together, as indicated in FIG. 2*c*.

In contrast to a solid partition sheet, reinforcement 80 is in essence a planar ring, albeit a generally D-shaped ring since it has one substantially straight side, namely that of the ridge plate defined by first portion 82. The ring has a large internal opening, indicated generally as 100. This ring serves three or more functions. First, it acts as a frame or former, or jig, during construction of the car. The jig facilitates installation of the upper vertices of the adjacent slope sheets. The jig also functions as a former that compels the skins of the sidewalls and the roof assembly to take on their arcuate shape, as do the corresponding curved outer edges of the obliquely inclined end slope sheets. The fabrication of these flat planar sections, and their installation, is simpler than the formation and installation of the previous hat-shaped sections, and avoids the sometimes problematic join where the hat sections formerly met the upper edge caps of the slope sheets. Second, each of (i) the side sheets and (ii) the roof sheet acts as a shear web between flanges of a beam of deep section. In the case of the roof sheet, the beam is formed by the co-operation of the two top chords and the roof sheet, and resists lateral loads. In the case of the sidewalls the deep beam is defined by a top chord, a side sill and a side sheet. In all three cases, the frames (however many there may be) deter out of plane deflection of the shear web (i.e., the curved skin). Thirdly, the rings may tend to act as a forcing node in buckling. That is, the car shell can be considered to approximate a thin-walled tin can, in which the wall thickness, as noted above, is of the order of $1/700^{th}$ of the width of the car. The rings and the slope sheets both tend to have an influence in the local adjacent structure to prevent local wrinkling of the membrane, and also to force global buckling of the structure into a higher mode according to the number of nodal points so defined. The rings may also tend to prevent or discourage the tendency of the sidewalls to bulge outwardly when the car is pressurized. That is, where a car has flat side walls, or flat sidewall portions, the skin, behaving in the manner of a web, may tend to oil-can outward when pressurized. However, a skin formed on a forced curvature may tend to carry the pressure in the form of a tensile stress in the skin and may resist this kind of grossly discernible deflection.

Each ring acts as the inwardly extending leg or stem of a section, where the flange of the section is defined by the skin of the shell. As opposed to a formed hat section, the leg has a solid rectangular section having a thickness and a depth. This depth may vary about the periphery. Fillet welds are made about the outer periphery of the leg on both sides. The region of influence of the leg is a function of the proportions of the leg (i.e., the stem of the section defined by the depth of the ring and its through thickness) and of the skin. Although it need not necessarily be so, it is convenient for the thicknesses of the three sectors of the horseshoe portion of the ring to be of the same thickness, and also convenient for the base or straight wall portion to be of that same thickness. The length of the leg (i.e., the depth of the section) is greater than the thickness, such that a long thin stem is formed that influences the adjacent regions of the skin, thus forming, in effect, a T-section. That thickness may be of the order of half an inch, while the leg depth may be of the order of 5 inches. The skin thickness of the wall may be of the order of 3/16". Inasmuch as the thickness of the leg is more than twice the thickness of the skin, and the depth of the leg is more than 8 times its own thickness, (i.e., it is about 10:1 to 12:1) its own local stiffness is substantially greater than the neighboring skin. Its effective influence may tend to extend 20 to 30 times the skin thickness to either side into the adjacent skin. At the same time, removing a large amount of material from reinforcement 80, by virtue of the large aperture, permits a savings of weight and prevention of pressure differential between the hopper sections.

The roof sheets may be formed on a circular arc with a substantially constant radius of curvature. In the embodiment illustrated, the side sheet skins (following the correspondingly curved profiles of reinforcements 80) have a predominant portion extending upwardly from the lap joint at the side sill that is formed on an elliptic curve. The use of an ellipse in this instance permits the car to retain a large internal volume while avoiding, or minimizing, the employment of large flat side sections, and provides the desired curvature at the side sill. The upper portion of the skins of the sidewalls runs on a tangent, that tangent portion forming an inner wall of the closed section of the top chord. As may be noted, the roof sheet is both welded at the intersection with the sidewall sheet tangential extension and at the locus of intersection of the roof sheet with the upper leg of the top chord.

As noted above, the ring may have a depth of section that is at least 4 times its thickness, and that is not formed in a hat shape or other out-of plane shape. Rather it may be formed by profile cutting a flat sheet or flat bar. The aspect ratio may be more on the order of about 10:1 to 12:1. The overall width of said internal periphery of the ring may typically be being at least 3/4 or 4/5 of the overall outer width of the frame. Expressed differently, the reinforcement 80 has an overall width measured across the second portion, and has the form of a hollow ring having a D-shape. The first portion forms a straight back of the D-shape. The second portion forms a continuously arcuate bulging portion of the D-shape. Reinforcement 80 has a wall depth (or leg length) of the arcuate portion that is less than 1/10 of the overall width of reinforcement 80. Expressed somewhat differently again, the car has a longitudinal centerline. A first area is defined in a vertical plane extending perpendicular to the longitudinal centerline. The hopper car has longitudinally extending side sills. The side sills having an uppermost extremity at the upper margin of the side slope sheets. There is a first area being bounded by an inside face of said skin above said uppermost extremities of the side sills. The open interior portion of the reinforcement has an open area equal to at least 60% of the first area. Expressed differently again, the covered railroad hopper car has a shell that is a pressure vessel. The pressure vessel has an overall width W. The second portion of the ring reinforcement has a leg length to thickness ration of greater than 8:1. There is a thickness ratio of the skin to the reinforcement of less than 1:2. The open area of the interior portion of the reinforcement has an hydraulic diameter of at least 3/5 W where the hydraulic diameter is defined as $D_h=4A/P$, where A is the area and P is the length perimeter.

The external skin of the shell includes at least one skin sheet having a thickness $t_{skin}$, and the second portion of the ring frame has a leg extending in a plane perpendicular to said skin sheet, the leg having a length greater than 10 times the skin thickness $t_{skin}$. In one embodiment the leg length may be of the order, on average, of about 25 or 30 times the skin thickness. The leg has a thickness that is more than 50% greater than the skin thickness $t_{skin}$. In one embodiment the leg thickness may be more than double that thickness, and may be 2½ to 3 times that thickness.

Various embodiments have been described in detail. Since changes in and or additions to the above-described examples may be made without departing from the nature, spirit or scope of the invention, the invention is not to be limited to those details.

We claim:

1. A covered hopper railroad freight car operable to roll along railroad tracks in a longitudinal direction, said covered hopper railroad freight car comprising:

a lading containment shell carried on railroad car trucks;

said lading containment shell having at least first and second hopper discharge sections, said first hopper discharge section having a first slope sheet, and said second hopper discharge section having a second slope sheet;

said shell having a peripherally extending reinforcement located between said first and second hopper discharge sections;

said reinforcement being located in a vertical plane oriented cross-wise to said longitudinal direction;

said reinforcement having a first portion, said first portion extending cross-wise across said car and having first and second surfaces to which upper margins of said first and second slope sheets mate;

said reinforcement having a second portion having sidewall and roof sheet profile defining sectors forming a downwardly opening U;

said shell having an external skin that includes respective first and second sidewall and roof sheets conforming to respective profiles of said profile defining sectors;

said profile defining sectors being free of (a) top hat section; and (b) other out-of-plane formed sections other than top hat sections;

said sidewall sheet profile defining sector of said reinforcement and said first sidewall sheet being mounted co-operably to define a T-section;

said sidewall sheet profile defining sector of said reinforcement defining a stem of said T-section;

said stem being of solid cross section; and said first and second portions of said shell peripherally extending reinforcement combining to define a ring frame having an open interior portion.

2. The covered hopper railroad freight car of claim 1 wherein:

each said sector has a solid cross-section, said cross-section having a depth of section for orientation substantially perpendicular to the first sidewall sheet, and having a thickness of section oriented cross-wise to said depth of section, said depth of section being at least 4 times said thickness;

said reinforcement having an internal opening formed therethrough, said internal opening having a periphery, and said reinforcement having an overall width;

said internal opening periphery having an overall width; and said overall width of said internal opening periphery being at least 80% of said overall width of said reinforcement.

3. The covered hopper railroad freight car of claim 1 wherein said first portion and said second portion are each of uniform thickness, and said first portion has the same thickness as said second portion.

4. The covered hopper railroad freight car of claim 1 wherein:

said reinforcement has an overall width measured across said second portion;

said reinforcement has the form of a hollow ring having a D-shape;

said first portion forms a back of the D-shape;

said second portion forms an arcuate bulging portion of the D-shape;

said reinforcement has a wall depth of said arcuate portion that is less than 1/10 of said overall width of said reinforcement;

said external skin of said shell includes at least one skin sheet having a thickness $t_{skin}$, said stem extends in a plane perpendicular to said skin sheet; and said stem having a length perpendicular to said skin sheet of greater than 10 times said thickness $t_{skin}$.

5. The covered hopper railroad freight car of claim 1 wherein said railroad freight car has a longitudinal centerline; a first area is defined in a vertical plane extending perpendicular to said longitudinal centerline, said hopper car having longitudinally extending side sills, said side sills each having an uppermost extremity; said first area is bounded by said skin above said uppermost extremities of said side sills; and said open interior portion of said reinforcement has an open area equal to at least 60% of said first area.

6. The covered hopper railroad freight car of claim 1 wherein said lading containment shell is a pressure vessel, said pressure vessel has an overall width W, said second portion of said reinforcement has a stem leg length to stem thickness ratio of greater than 8:1, there is a thickness ratio of said skin to said reinforcement of less than 1:2, and an open interior portion of said reinforcement includes an area having an hydraulic diameter of at least 3/5 W.

7. The covered hopper railroad freight car of claim 1, wherein, at least one of said first and second hopper discharge sections is a hopper discharge outlet section having a generally four sided inlet, and a round outlet, and wherein said railroad freight car further comprises:

a pair of side sill assemblies, each side sill assembly including a longitudinally extending channel section and a hopper discharge side sheet member, a portion of the hopper discharge side sheet member mating with said longitudinally extending channel section to form a closed section beam;

a pair of slope sheets extending cross-wise to said side sill assemblies, said pair of slope sheets being co-operably mounted relative to said side sheet members to form a four-sided pyramid opening; and a set of transition sheets mounted on inclined corners between said side sheet members and said slope sheets;

said transition sheets having lower margins co-operating to define a circular outlet opening.

8. A covered hopper railroad freight car having a car body for containing lading, said car body being carried on trucks for rolling motion in a longitudinal direction along railroad tracks, said car body comprising:

a first hopper and a second hopper, said first hopper being next adjacent to said second hopper in said longitudinal direction;

a lading containment shell including roof and sidewall portions;

a ring reinforcement to which said lading containment shell is mounted, said ring reinforcement being mounted crosswise to said longitudinal direction;

said ring reinforcement including a first portion defining a ridge plate between said first and second hoppers, and a second portion co-operating with said first portion to define a D-shaped ring, said D-shaped ring having an open interior portion, said D-shaped ring being free of formed members having out-of-plane cross-sections;

each of said first hopper having a first discharge section, and said second hopper having a second discharge section;

said first discharge section having a first outlet, and a first set of slope sheets downwardly convergently arranged to feed said first outlet;

said second discharge section having a second outlet, and a second set of slope sheets downwardly convergently arranged to feed said second outlet;

said first set of slope sheets including a first intermediate slope sheet;

said second set of slope sheets including a second intermediate slope sheet;

said first and second intermediate slope sheets having respective upper marginal edges;

said first portion of said ring reinforcement being made of a solid, planar member having a thickness and a depth, said depth being greater than said thickness;

said first portion having a first face and an opposed second face;

said upper marginal edge of said first intermediate slope sheet being mated to said first face of said first portion of said ring reinforcement; and said upper marginal edge of said second intermediate slope sheet being mated to said second face of said first portion of said ring reinforcement.

9. The covered hopper railroad freight car of claim 8 wherein said second portion of said ring reinforcement has the shape of a downwardly open horseshoe, mated to said first portion.

10. The covered hopper railroad freight car of claim 9 wherein:

said second portion of said ring reinforcement includes a first sector, a second sector and a third sector;

said lading containment shell includes a first arcuate sidewall portion, a second arcuate sidewall portion, and an arcuate roof portion;

said lading containment shell conforms to said first, second and third sectors of said second portion of said ring reinforcement;

said first, second, and third sectors of said second portion of said ring reinforcement each being of solid rectangular section; and when assembled, said first, second, and third sectors of said second portion of said ring reinforcement extend inwardly of said first and second arcuate sidewall portions and said arcuate roof portion of said lading containment shell, and defining solid stems of T-sections formed respectively therewith.

11. The covered hopper railroad freight car of claim 10 wherein said first sector, second sector and third sector are all cut from flat bar and welded together co-planarly to form a downwardly opening horseshoe shape lying in a plane transverse to said longitudinal direction.

12. The covered hopper railroad freight car of claim 11 wherein said first, second and third sectors of said second portion of said ring reinforcement and said first portion of said ring reinforcement are all cut from flat bar of the same thickness.

13. The covered hopper railroad freight car of claim 8, said car having a longitudinal centerline, and wherein:

a first area is defined in a vertical plane extending perpendicular to said longitudinal centerline;

said hopper car has longitudinally extending side sills, said side sills having an uppermost extremity;

said first area is bounded by an inside face of said lading containment shell above said uppermost extremities of said side sills; and said open interior portion of said reinforcement ring having an open area equal to at least 60% of said first area.

14. The covered hopper railroad freight car of claim 8 wherein said lading containment shell defines a pressure vessel, said lading containment shell has a shell wall skin, said wall skin has a thickness, $t_{skin}$, said lading containment shell has an overall width W, said second portion of said reinforcement has a leg length, $I_{leg}$, and a leg thickness, $t_{leg}$, a ratio of $I_{leg}$:$t_{leg}$ being greater than 8:1, a ratio of $t_{skin}$:$t_{leg}$ being less than 1:2, and an open area of said open interior portion of said ring reinforcement having an area having an hydraulic diameter of at least ⅗ W.

15. The covered hopper railroad freight car of claim 8 wherein said lading containment shell has sidewall sheets that mate in substantial slope continuity with slope sheets of said first and second hopper discharge sections.

16. The covered hopper railroad freight car of claim 8 further comprising:

at least one of said first and second hopper discharge sections having a generally four sided inlet, and a round outlet;

a pair of side sill assemblies, each side sill assembly including a longitudinally extending channel section and a hopper discharge side sheet member, a portion of the hopper discharge side sheet member mating with said longitudinally extending channel section to form a closed section beam;

a pair of slope sheets extending cross-wise to said side sill assemblies, said pair of slope sheets being co-operably mounted relative to said side sheet members to form a four-sided pyramid opening; and a set of transition sheets mounted on inclined corners between said side sheet members and said slope sheets;

said transition sheets having lower margins co-operating to define a circular outlet opening.

17. The covered hopper railroad freight car of claim 8 wherein:

said car body is a pressure vessel having sealed hopper covers and pressure piping operable to discharge granular lading therefrom;

said lading containment shell includes an arcuate roof sheet and first and second arcuate sidewall sheets;

said first and second hopper discharge sections have respective side slope sheets;

said sidewall sheets meet said first and second hopper discharge sections at junctures having substantial slope continuity;

said second portion of said ring reinforcement includes a first sector, a second sector and a third sector;

said lading containment shell includes a first arcuate side wall portion, a second arcuate sidewall portion, and an arcuate roof portion;

said lading containment shell conforms to said first, second and third sectors of said second portion of said ring reinforcement;

said first, second, and third sectors of said second portion of said ring reinforcement are each of solid rectangular section; and when assembled, said first, second, and third sectors of said second portion of said ring reinforcement extend inwardly of said first and second arcuate sidewall portions and said arcuate roof portion of said lading containment shell, and defining solid stems of T-sections formed respectively therewith;

said lading containment shell has a shell wall skin, said skin has a thickness, $t_{skin}$;

said pressure vessel has an overall width W;

said second portion of said reinforcement has a leg length, $I_{leg}$, and a leg thickness, $t_{leg}$, a ratio of $I_{leg:tleg}$ being greater than 8:1, a ratio of $t_{skin}$:$t_{leg}$ being less than 1:2, and an open area of said open interior portion of said ring reinforcement having an area having an hydraulic diameter of at least ⅗ W.

18. A covered hopper railroad freight car comprising:

a lading containment body carried on railroad car trucks for rolling motion in a longitudinal direction along railroad tracks;

said lading containment body having at least a first hopper and a second hopper;

said lading containment body including a ring reinforcement mounted between said first hopper and said second hopper in a vertical plane oriented cross-wise to said longitudinal direction, said ring reinforcement having an open central portion;

said lading containment body including an external shell structure being mounted to said ring reinforcement;

said first hopper having a first hopper discharge;

said second hopper having a second hopper discharge;

said first hopper including a first intermediate slope sheet;

said second hopper including a second intermediate slope sheet;

said first intermediate slope sheet being inclined upwardly from said first hopper discharge in the longitudinal direction toward said second hopper;

said first intermediate slope sheet having an upper margin adjacent to said ring reinforcement;

said second intermediate slope sheet being inclined upwardly from said second hopper discharge in the longitudinal direction toward said first hopper;

said second intermediate slope sheet having an upper margin adjacent to said ring reinforcement;

said ring reinforcement including a first portion and a second portion;

said second portion of said ring reinforcement including first, second, and third sectors;

said first portion of said ring reinforcement, and each of said first, second, and third sectors of said second portion being cut from flat bar and having solid sections, each section having a depth of section and a thickness, said depth of section being greater than said thickness;

said first portion of said ring reinforcement, and all of said first, second, and third sectors of said second portion being welded together in said ring reinforcement, and, as assembled, all being co-planar and defining an open centered, D-shaped ring;

said first, second and third sectors of said second portion having respective arcuate externally facing edges;

said shell structure including sheets conforming to said arcuate externally facing edges of said first, second, and third sectors of said second portion of said ring reinforcement, with the respective depths of section of said first, second and third sectors of said second portion of said ring reinforcement extending away from said sheets, respectively to define stems of respective T-sections;

said D-shaped ring having an overall width;

said D-shaped ring having an opening defined therein;

said opening in said D-shaped ring having an overall width; and said overall width of said opening of said D-shaped ring being at least ¾ as great in magnitude as said overall width of said D-shaped ring.

19. The covered hopper railroad freight car of claim 18 wherein said sheets of said shell structure have a wall thickness and said first and second sectors of said second portion of said ring reinforcement have respective through thicknesses that are more than 50% greater than said wall thickness of said sheets of said shell structure.

20. The covered hopper railroad freight car of claim 19 wherein said respective through thicknesses of said portions of said ring reinforcement are more than double said wall thickness of said shell structure, and said respective first and second sectors define T-section stems relative to said sheets of said lading containment body shell structure, said stems having a leg length more than eight times their respective through thicknesses.

* * * * *

UNITED STATES PATENT AND TRADEMARK OFFICE

CERTIFICATE OF CORRECTION

PATENT NO. : 7,908,975 B2
APPLICATION NO. : 11/939993
DATED : March 22, 2011
INVENTOR(S) : James W. Forbes It is certified that error appears in the above-identified patent and that said Letters Patent is hereby corrected as shown below:

Column 11, Claim 10, line 50 - insert --D-shaped-- before “ring”

Column 11, Claim 10, line 53 - insert --D-shaped-- before “ring”

Column 11, Claim 10, line 56 - insert --D-shaped-- before “ring”

Column 11, Claim 10, line 57 - replace “sidewall” with “side wall”

Column 13, Claim 17, line 2 - insert --D-shaped-- before “ring”

Column 13, Claim 17, line 5 - insert --D-shaped-- before “ring”

Column 13, Claim 17, line 6 - replace “sidewall” with “side wall”

Signed and Sealed this
Twenty-fourth Day of May, 2011

David J. Kappos

David J. Kappos
*Director of the United States Patent and Trademark Office*